US008677867B2

(12) United States Patent
Fachorn

(10) Patent No.: US 8,677,867 B2
(45) Date of Patent: Mar. 25, 2014

(54) LOCKING STRAP HOLDER-SEAMER

(76) Inventor: Mark Fachorn, Willow Spring, NC (US)

( * ) Notice: Subject to any disclaimer, the term of this patent is extended or adjusted under 35 U.S.C. 154(b) by 322 days.

(21) Appl. No.: 13/100,829

(22) Filed: May 4, 2011

(65) Prior Publication Data

US 2011/0271799 A1 Nov. 10, 2011

Related U.S. Application Data

(60) Provisional application No. 61/330,914, filed on May 4, 2010.

(51) Int. Cl.
*B25B 7/02* (2006.01)
*B25B 7/14* (2006.01)
*B25B 7/22* (2006.01)

(52) U.S. Cl.
USPC ..... 81/420; 81/319; 81/424.5; 81/427.5

(58) Field of Classification Search
USPC ..... 81/418–420, 424.5, 426.5, 319, 395, 81/367, 368, 427.5
See application file for complete search history.

(56) References Cited

U.S. PATENT DOCUMENTS

| | | | | |
|---|---|---|---|---|
| 1,085,461 | A * | 1/1914 | Michaelis | 81/419 |
| 1,781,419 | A * | 11/1930 | Wallace | 81/420 |
| 2,972,270 | A | 2/1961 | Krolick | |
| 4,049,268 | A | 9/1977 | Ray | |
| 4,299,146 | A | 11/1981 | Phelps | |
| 4,386,542 | A | 6/1983 | Verna | |
| 4,386,543 | A | 6/1983 | Walker, Jr. | |
| 5,537,727 | A * | 7/1996 | Mayer | 81/424.5 |
| 6,839,949 | B1 * | 1/2005 | Miknich | 81/424.5 |
| 2012/0000019 | A1 * | 1/2012 | Steele et al. | 81/427.5 |

* cited by examiner

*Primary Examiner* — Hadi Shakeri
(74) *Attorney, Agent, or Firm* — Daniel Boudwin; Global Intellectual Property Agency LLC

(57) ABSTRACT

A lockable pipe support holding device of the plier type is provided, having large flat jaws for gripping pipe straps, shoes, hangers and materials. The jaws have a textured inner surface and notched grooves along the lateral edges to promote firm grip on metal and bending of the same. A "U" shaped recess along the front edge of the jaws allows fasteners to be inserted into a strap or similar object being securely held by the tool. A user may adjust the gap between jaws by means of an adjustment screw in a handle. In addition the jaws may be locked in place and then unlocked by means of a lever housed in a handle. Consequently, a user may insert fasteners into a working area of an object without having to hold onto the tool while doing so.

4 Claims, 2 Drawing Sheets

LOCKING STRAP HOLDER-SEAMER

CROSS REFERENCE TO RELATED APPLICATION

Figure 1:
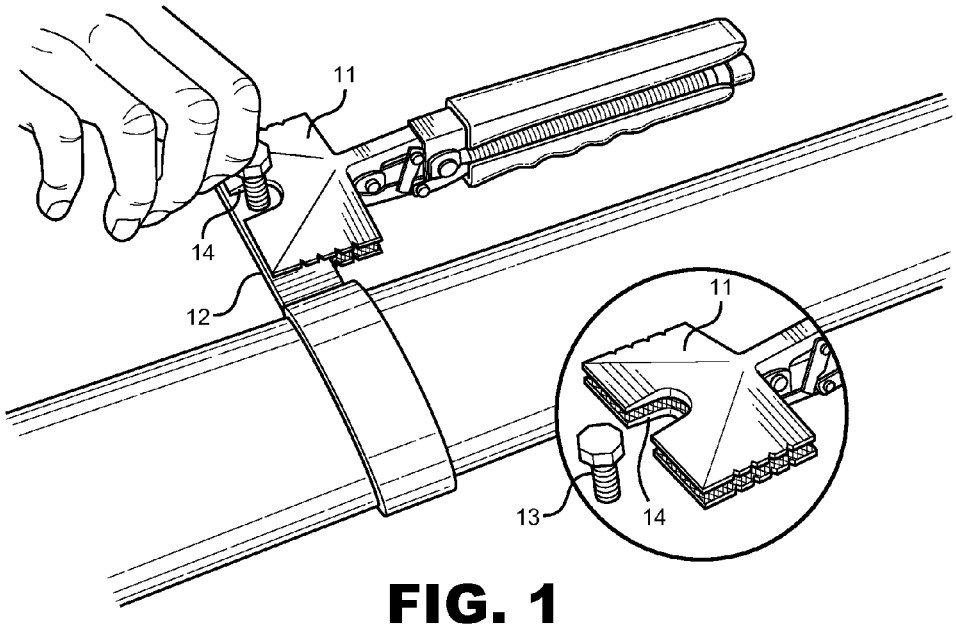

This application claims the benefit of U.S. Provisional Application No. 61/330,314 filed on May 4, 2010, entitled "Locking Strap Holder-Seamer."

BACKGROUND OF THE INVENTION

1. Field of the Invention

The present invention relates to a handheld gripping tool and more specifically to a lockable strap holder for securely holding straps or other materials while a fastener is being inserted into the same.

While pipe is being installed in a building, it must be secured to support structures to ensure that flow of air or liquid is not obstructed by dislodged sections of pipe. Builders use objects known as "pipe supports" in order to achieve this goal. Pipe supports include pipe shoes, straps, and hangers that are used for securing the pipe to the floor, wall and to overhead structures. In practice the pipe supports are usually bands of varying thickness material, constructed of metal and shaped to accommodate a certain size of pipe. If the pipe support is not adequately sized or shaped it may be bent to adapt it to the necessary requirements. After the support is fitted snuggly against the pipe, fastening means are inserted to secure the pipe into the desired position.

In the past a variety of tools have been used for the purpose of gripping shoes, straps, and hangers. Some tools are specialized to allow the aforementioned materials to be bent, straightened or otherwise manipulated. Unfortunately prior gripping devices available to tradesmen do not allow insertion of fasteners into the securely held area of pipe support material. A user must first grip the strap, shoe, or hanger with a tool and then struggle to ensure the surrounding area remains aligned while the fastener is inserted. Such procedures result in difficulty inserting fastening, which can result in loss of time or user injury.

The present invention solves this problem by providing a means for inserting fasteners of varying type into a securely held work area. In addition, the present device is lockable, allowing a user to use both hands to accomplish the task of securing fasteners rather than requiring a user to hold the tool with one hand while inserting fasteners with the other. Thus the present invention reduces the time spent struggling securing fasteners, and reducing potential for injury caused by tool slippage or loss of grip.

2. Description of the Prior Art

The prior art contains a variety of handheld gripping devices for securely holding straps, shoes, hangers and other materials. These devices have familiar design and structural elements for the purposes of gripping pipe supports; however they are not adapted for the task of securing fasteners within the working area of the object held by the device.

Krolick, U.S. Pat. No. 2,972,270 discloses a handheld gripping device for securing and bending sheet metal. The device comprises two handles pivotally attached to a set of jaws. The jaws have flat inside surfaces which are textured for increased grip on metal objects.

Phelps, U.S. Pat. No. 4,299,146 discloses a handheld clamping device having two flat jaws, the second jaw being pivotally adapted to accommodate materials of varying sizes between said jaws. Two supporting members located on either end of the second jaw provide a means for additional clamping force to be exerted on objects within the jaws.

Verna, U.S. Pat. No. 4,386,542 discloses handheld lockable pliers having a large planar plate attached to each member, and the surface of the plates having rows of arcuate teeth for gripping sheet metal.

Walker, Jr. U.S. Pat. No. 4,386,543 discloses a handheld lockable sheet metal gripping device having two flat jaws attached handles. One handle contains a means for screwing the jaws into locked position and the other handle contains a lock release mechanism.

The devices disclosed by the prior art do not address the need for holding a strap or other construction material in place while fasteners are secured therethrough. The current invention relates to a device for securely holding a strap that allows a user to lock the tool grip in place while fasteners are secured to the gripped material. It substantially diverges in design elements from the prior art, consequently it is clear that there is a need in the art for an improvement to the existing lockable holder tools for straps and other construction materials. In this regard the instant invention substantially fulfills these needs.

SUMMARY THE INVENTION

In view of the foregoing disadvantages inherent in the known types of handheld gripping devices now present in the prior art, the present invention provides a new means for securing fasteners to the working area of a pipe strap, shoe, hanger or other objecting held by the device wherein the same can be utilized for providing convenience for the user when inserting a fastener into the working area of a securely held pipe support. The device comprises two handles, each securely attached to a jaw member. The handles are pivotally attached at a fulcrum near the jaw members to allow said jaws to open and close, and to allow secure mating of both jaw surfaces. The device locks in the manner standard within the locking gripping tool art. One handle houses an adjustment screw that protrudes from the handle end allowing a user to adjust the distance between the jaw members and accommodate varying objects therebetween. The second handle contains a lever for locking the jaw members in position, and for releasing said lock. To enhance comfort to the user, the handles may include non-slip coverings, and may have finger grips molded into said coverings.

The jaws of the device are two large planar members having a textured interior surface to promote better grip on objects therebetween. Along the front edge of each jaw is a "U" shaped recess cut out. This recess provides a user with the ability to insert and affix fasteners into a pipe strap, shoe, hanger or other object while the same is being gripped by said jaws. Small indentations along the sides of the plates facilitate bending of sheet metal held by the device.

It is therefore an object of the present invention to provide a new and improved handheld pipe support holding device that has all of the advantages of the prior art and none of the disadvantages.

Another object of the present invention is to provide a new and improved handheld pipe support holding device that contains "U" shaped recesses along the front edges of the jaws to allow a user to insert and remove fasteners from the working area of an object being securely gripped.

Yet another object of the present invention is to provide a new and improved handheld pipe support holding device that has notched grooves along its lateral edges to facilitate bending of sheet metal.

Still another object of the present invention is to provide a new and improved handheld pipe support holding device that locks the jaw members in position so a user does not have to exert force on the handles while inserting or removing a fastener from the object being held.

A further object of the present invention is to provide a new and improved handheld pipe support holding device that consists of non-slip coverings on device handles to reduce loss of grip strength due to dirt and oils on a user's hands.

Another object of the present invention is to provide a new and improved handheld pipe support holding device that has resilient and durable construction.

Other objects, features and advantages of the present invention will become apparent from the following detailed description taken in conjunction with the accompanying drawings.

BRIEF DESCRIPTIONS OF THE DRAWINGS

The above invention will be better understood and the objects set forth above as well as other objects not stated above will become more apparent after a study of the following detailed description thereof. Such description makes use of the annexed drawings wherein:

FIG. 1, shown is a perspective view of a preferred embodiment of the present invention in use. A pipe strap is held by the device in a locked position while a user manually inserts a fastener into the strap. A magnified view of the front edges of the device is shown, depicting the "U" shaped cutout and a fastener.

Figure 2:
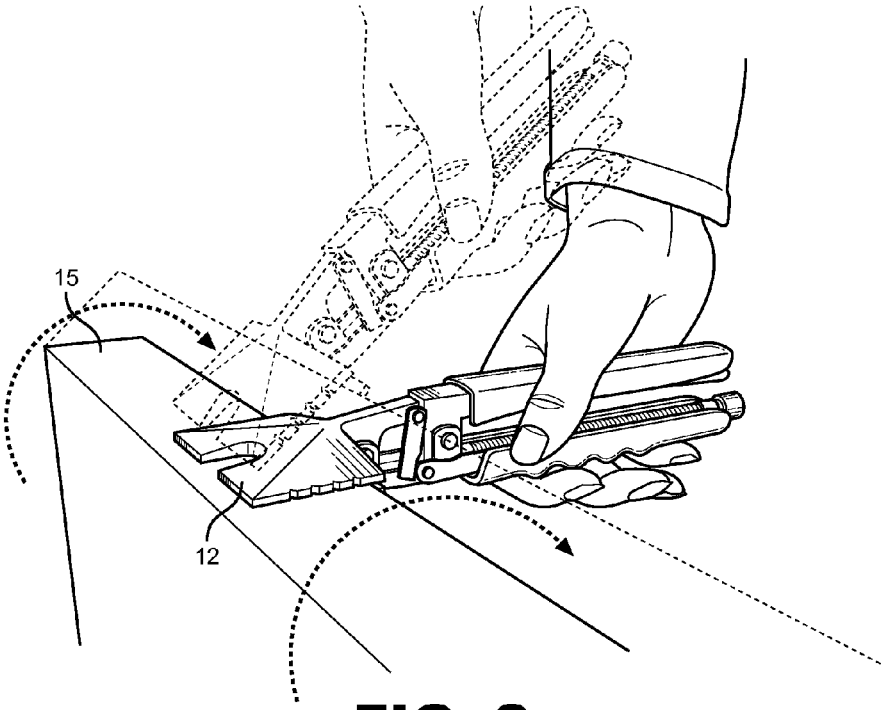

FIG. 2, shown is a perspective view of a preferred embodiment of the present invention in its working position, bending sheet metal. A user grips the device by the handles to exert a clamping force on a work piece while rotating the handle to bend the material.

Figure 3:
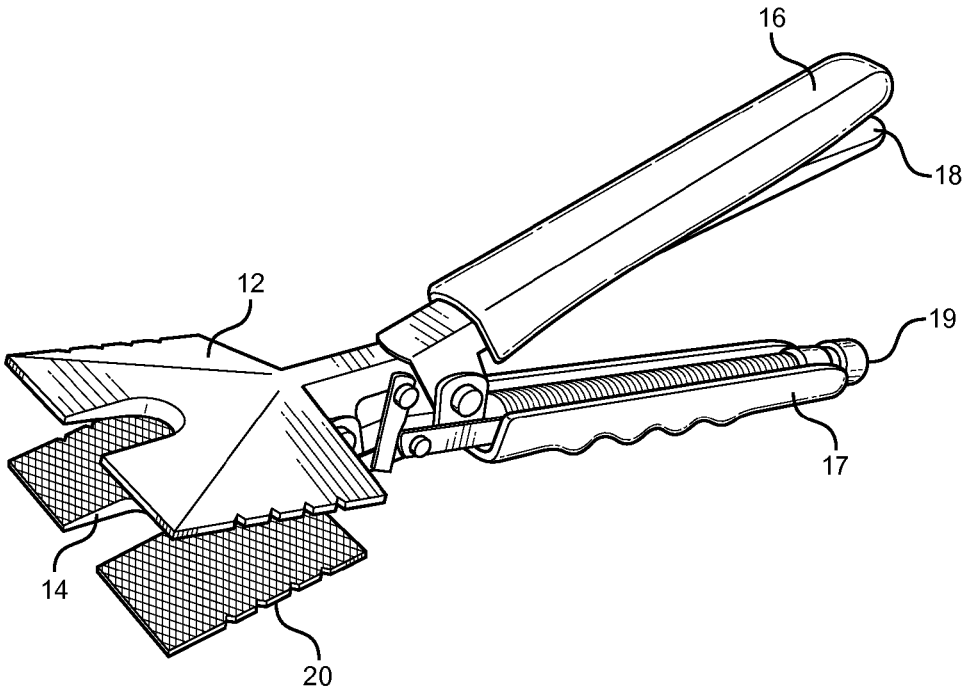

FIG. 3, shown is a perspective view of a preferred embodiment of the present invention with its jaw members in an open position.

Figure 4:
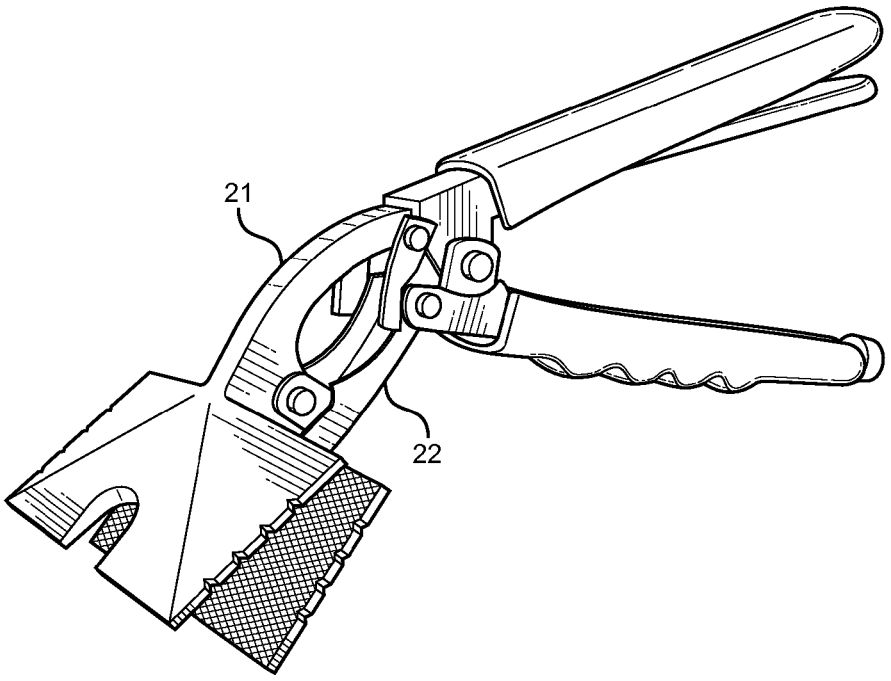

FIG. 4, shown is perspective view of a second embodiment of the present invention having jaw members securely attached to curved portions of the handle arms.

DETAILED DESCRIPTION OF THE INVENTION

Reference is made herein to the attached drawings. Like reference numerals are used throughout the drawings to depict like or similar elements of the claimed handheld pipe support gripping device. For the purposes of presenting a brief and clear description of the present invention, the preferred embodiment will be discussed as used for securely holding a strap, shoe, hanger or other similar object. The illustrations are for representative purposes only and should not be considered to be limiting in any respect.

Referring now to FIG. 1, there is shown the pipe support holding tool of the plier type in use. The tool is in a locked position with its planar jaw members 11 snugly gripping a pipe strap 12. In the locked position, the tool does not require action by a user in order to maintain the tool's secure hold on the strap 12. While the strap 12 is held firmly in place, a fastener 13 may be inserted by a user into the strap 12 and through a "U" shaped recess 14 along the front edges of the jaw members 11.

Referring now to FIG. 2, there is shown the strap holding tool of the present invention as used for bending sheet metal 15. The edge of the sheet metal 15 is gripped between the jaws 11 of the tool which may be in the locked or unlocked position. The user holding the tool then exerts a downward rotational force to bend the metal 15. The forward edge of the tool creates a crease in the metal, and a corresponding fold line.

Referring now to FIG. 3, there is shown the strap holding tool of the present invention in an open, unlocked position. The device has an upper handle arm 16 and lower handle arm 17 that are attached at a fulcrum near the front end of the device. Each handle arm 16, 17 is rigidly attached to a planar jaw member 11. Housed in the upper handle arm 16 is an adjustment screw means 19 for adjusting the height of the space between the planar jaw members 11. The lower handle arm 17 houses a lock release lever 18 that may be depressed by a user to release the tool from its locked position. To promote safe handling of the tool by users who may have dirt or oil on their hands, both handles are covered in a non-slip, high friction material such as textured rubber or plastic. To further promote safe handling of the tool, the non-slip covering of the lower handle arm 17 may have a grooves adapted to fit a user's fingers.

The jaw members 11 are planar with a textured inner surface. This surface may be patterned in any way that allows the jaw members 11 to mate flush together. Along the front edge of the jaws 11 are "U" shaped recesses 14. The recess of the upper and lower jaw members 11 align vertically, allowing a user to insert fasteners into the part of a working area exposed by the recess 14. Along their lateral edges, the jaws have notched grooves 20 to assist with bending of metal. In the preferred embodiment the jaw members 11 are two inches deep, four inches wide, and ¼ inches thick, with a one inch depth for the "U" shaped recess 14. Any dimension set that preserves proportionality is acceptable, while any acceptable size deemed acceptable by one skilled in the art is also acceptable.

An alternate embodiment of the present strap holding tool device is shown in FIG. 4 and includes a curved portion of the handle arms 16, 17. The upper curved portion 21 has a downward curvature extending from the upper handle arm 16 to the corresponding jaw member 11. The lower curved portion 22 may be flat or have a shallow curvature extending upwards towards the corresponding jaw member 11. Other embodiments contemplated but not shown in the figures include a tool having a plurality of "U" shaped recesses along the front edge to accommodate multiple fasteners. The tool in any embodiment may be made of any durable, high impact metal such as steel.

In use an individual grips the tool device by its handles 16, 17 and positions the tool so that a desired pipe strap 12 or other object is placed between the jaw members 11. A user then squeezes the handles 16, 17 together to close the jaws 11 around the pipe strap 12. The tool's grip may be adjusted using the screw means 19 in the lower handle arm 17 to modify the gap between the jaws 11 and therefore the associated clamping pressure. The tool is then placed in a locked position allowing a user to release his or her hold on the handles 16, 17. Fasteners 13 are placed into the strap 12 through the "U" shaped recess 14 and torqued by the user. The tool is then removed from the locked position by the user releasing the lock release lever 18 contained in the lower handle arm 17.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim the following:

1. A handheld gripping tool device comprising:

an upper arm and lower arm whereby each of said arms comprises a planar jaw member end and a handle arm end, said upper arm and said lower arm being connected at a pivotable attachment, a lock adapted to secure said upper arm and lower arm in a static position with respecting to each other;

said upper arm having a lock release lever and said lower arm having a screw means adapted to adjust the height of a gap between the planar jaw members of said upper arm and lower arm, said jaw member ends having a textured inner surface, said textured inner surfaces of said jaw member ends being in opposition with respect to one another;

said jaw member ends having an aligned "U" shaped recess cut away from a front edge of said jaw members and adapted to accommodate a fastener therethrough;

said textured inner surface of said jaw member ends comprising a widened area having lateral edges;

said lateral edges further comprising notched grooves therealong adapted to facilitate metal bending operations.

2. The device of claim 1, wherein:

said handle arm ends are covered in a high friction material.

3. The device of claim 1, wherein:

said lower handle arm ends employ molded finger grips.

4. The device of claim 1, wherein:

said upper arm and said lower arm have a downwardly curving portion between their pivotal attachment and said planar jaw member ends thereof.

* * * * *